US005388496A

United States Patent [19]

Miller et al.

[11] Patent Number: 5,388,496

[45] Date of Patent: Feb. 14, 1995

[54] ELECTRONIC TUNING DEVICE

[75] Inventors: Gary Miller; Doran M. Oster; Charles G. Crampton, all of Gainesville, Fla.

[73] Assignee: Sabine Musical Manufacturing Company, Inc., Gainesville, Fla.

[21] Appl. No.: 124,752

[22] Filed: Sep. 22, 1993

[51] Int. Cl.[6] ..... G10G 7/02

[52] U.S. Cl. ..... 84/454; 324/76.11

[58] Field of Search ..... 84/454, DIG. 18; 324/76.11, 79 D

[56] References Cited

U.S. PATENT DOCUMENTS

| | | | |
|---|---|---|---|
| 4,014,242 | 7/1977 | Sanderson | 84/454 |
| 4,018,124 | 4/1977 | Rosado | 84/454 |
| 4,019,419 | 4/1977 | Yoshikawa et al. | 84/454 |
| 4,041,832 | 8/1977 | Risch | 84/454 |
| 4,319,515 | 3/1982 | Mackworth-Young | 84/454 |
| 4,429,609 | 2/1984 | Warrender | 84/454 |
| 4,523,506 | 6/1985 | Hollimon | 84/454 |
| 4,648,302 | 3/1987 | Bozzio | 84/730 |
| 4,665,790 | 5/1987 | Rothschild | 84/454 |
| 4,688,464 | 8/1987 | Gibson et al. | 84/454 |
| 4,796,509 | 1/1989 | Mizuguchi et al. | 84/454 |
| 4,899,636 | 2/1990 | Chiba et al. | 84/454 |
| 4,984,498 | 1/1991 | Fishman | 84/730 |
| 5,016,515 | 5/1991 | Scott | 84/454 |
| 5,285,711 | 2/1994 | Sanderson | 84/454 |

*Primary Examiner*—Vit W. Miska

*Attorney, Agent, or Firm*—Donald W. Marks

[57] ABSTRACT

An electronic tuning device includes a display with a single row of LED's corresponding to musical notes wherein the sensing of a fundamental frequency of an input tone causes the operation of the corresponding LED to indicate the nearest note. Additionally the LED is operated in manner, such as blinking proportionally to the variation from the note and/or producing different colors, such as green, red and amber, to indicate in-tune and out-of-tune conditions. A double back adhesive rubber pad can be used to removably mount the tuner on an instrument, so that the device can simply pulled off the musical instrument to make it ready for its next use. The rubber pad serves to attenuate high frequency mechanical vibrations of the musical instruments thus improving the accuracy and versatility of the unit. In one embodiment, the display is mounted externally on the musical instrument while the tone sensing circuitry is mounted inside the musical instrument such within the sound box of an existing guitar.

12 Claims, 4 Drawing Sheets

ELECTRONIC TUNING DEVICE

BACKGROUND OF THE INVENTION

1. Field of the Invention

The present invention relates to tuning devices for musical instruments, and-more specifically, to electronic tuning devices employing LED displays for indicating the tuning of almost any type of musical instrument including stringed percussive instruments such as guitars, pianos, harps, etc., and electronic musical instruments which have microphone pickups and amplifiers to generate acoustical sound vibrations in the air by speakers.

2. Description of the Prior Art

Traditional tuning of instruments is often done with one or more tuning forks, or other accurate tone sources, and a trained ear. In this process, the artisan often uses the phenomenon of "beats" to fine tune the instrument. A beat is an apparent oscillation of the loudness of a perceived tone when that tone is produced by two simultaneous tones of nearly, but not exactly the same frequency. Beats occur at a frequency equal to the difference between the two generating frequencies. For example, if a tuning fork is vibrating at a frequency of 440 Hz (440 cycles per second or in musical terms an A note) and a piano string is simultaneously vibrating at a fundamental frequency of 443 Hz, a definite rising and falling in the volume of the perceived tone will occur at a rate of three cycles per second. As the two tones approach the same frequency the beat frequency will reduce to zero. At a beat frequency of zero there is simply no variation in the volume of the combined tone. When a beat frequency occurs there is no way to tell which of the two tones (the tuning fork or the piano) is the higher frequency. When a three Hertz beat occurs the technician can only be sure the string is three Hertz off from the standard tone. Whether the string is sharp or flat still had to be determined by ear. Many times a trial adjustment was made and if the beat got faster, the knowledge was gained that the adjustment was in the wrong direction. The traditional method of tuning instruments left a lot to be desired and was entirely dependent on the skill of the tuning technician.

An electronic tuner for musical instruments has been marketed by Sabine Musical Manufacturing Company, Inc. of Gainesville, Fla. since about 1987. For tuning traditional musical instruments, i.e. non-electronic instruments, the tuner is set on a table top and uses a built-in microphone to sense tones produced by the musical instruments. For tuning electronic instruments, a signal output from the instrument or amplifier is directly connected by a cable to the electronic tuner. The LED display of this prior art tuning device consists of a bottom row of twelve lights corresponding to the twelve musical notes in an octave, i.e. A, A# (B♭), B, C, C# (D♭), D, D# (E♭), E, F, F# (G♭), G and G# (A♭). A separate top row of three lights is provided for indicating flat, in-tune or sharp tuning conditions, respectively. The flat and sharp error indicating lights are operated at blink rates proportional to the magnitude of error. During tuning the musician must constantly monitor both rows of LED's, and in the absence of such concentration, a change to the wrong note can be overlooked resulting in tuning of the instrument or string to the wrong note.

Electronic tuning devices of the above type work best with the electronic instruments where electrical signals from the electronic instruments are fed directly into the tuning device circuitry. Use of a microphone to pickup the tone from air-transmitted sound from acoustic instruments is susceptible to error or difficulty in tuning due to ambient noise also picked up by the microphone. Such ambient noise or interfering tones are subject to being confused by the tuning device with the tone being transmitted by the instrument resulting in failure or difficulty in obtaining a tuning indication from the tuning device.

The prior art, as exemplified by U.S. Pat. Nos. 4,018,124 (Rosado), 4,319,515 (Mackworth-Young) and 4,899,636 (Chiba et al.), contains a number of devices which are mountable on musical instruments for providing a display useable in tuning the instruments. Rosado and Chiba et al. are mountable on guitars with Chiba et al. being releasably mounted by a sucker and having a rubber vibration inputting member serving to prevent noise. The Chiba et al. tuner case has a resonant frequency characteristic functioning as a low-pass filter to attenuate higher harmonics of the fundamental frequency.

U.S. Pat. Nos. 4,648,302 (Bozzio) and 4,984,498 (Fishman) disclose mounting acoustic transducers on drums by double sided adhesive foam rubber tape. Bozzio states that re-attachable adhesives can be used. Additionally Fishman employs a silicone RTV adhesive on the transducer for dampening high-frequency resonances.

SUMMARY OF THE INVENTION

The invention is summarized in an improved electronic tuning device for a musical instrument wherein the tuning device has a display with a row of light sources corresponding to musical notes; one of the light sources being operated to indicate the nearest musical note to a determined fundamental frequency of musical tone generated by the musical instrument; and the operation of the operated light source being controlled to indicate any deviation of the determined fundamental frequency from the nearest musical note. A transducer converts the musical tone played by the musical instrument into electrical signals from which is determined the fundamental frequency of the musical tone. The nearest musical note to said fundamental frequency of said musical tone is computed and the corresponding light source is operated to indicate both the nearest musical note and the deviation.

Accordingly, it is a principal object of the invention to provide an improved musical instrument tuning device which is easier for the user to operate and tune a musical instrument to the correct musical note.

Another object of the invention to provide an electronic tuning device with a timed power shutoff feature which prevents unintentional discharging of the battery power source and which can be readily disabled for extensive tuning procedures.

One advantage of the invention is that a single light emitting source in a row of light emitting sources can be monitored to determine what musical tone is being played and whether that tone is sharp, flat, or in-tune with the desired musical note.

Additional features of the invention include the provision of three-color light sources for indicating notes in a scale of notes wherein the color indicates sharp, flat and in-tune conditions of the notes; the provision of blinking light sources for indicating notes in a scale of notes .and deviations of tones from the notes; and automatic power off with simple disablement of the power off feature.

Other objects, advantages and features of the present invention will be apparent from the following detailed description of the preferred embodiments and the accompanying drawings.

DETAILED DESCRIPTION OF THE PREFERRED EMBODIMENTS

Figure 1:
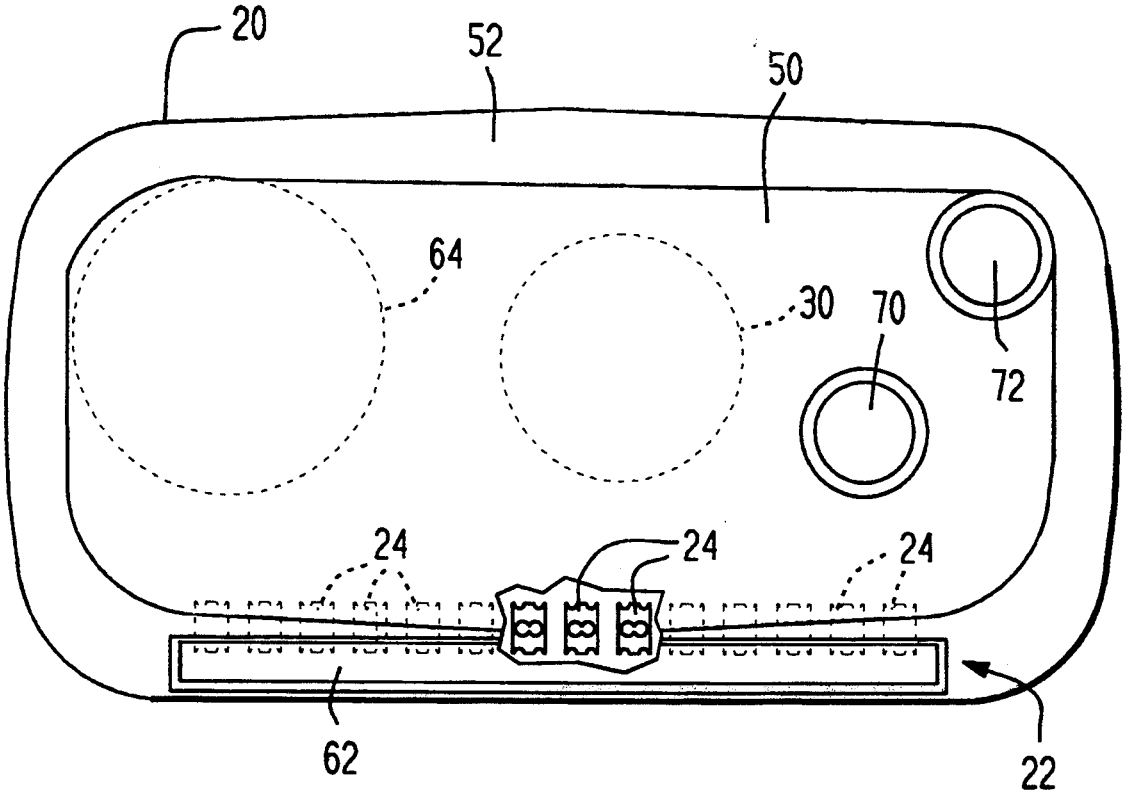
FIG. 1 is top plan view with a portion broken away of an electronic tuning device in accordance with the invention.
Figure 2:
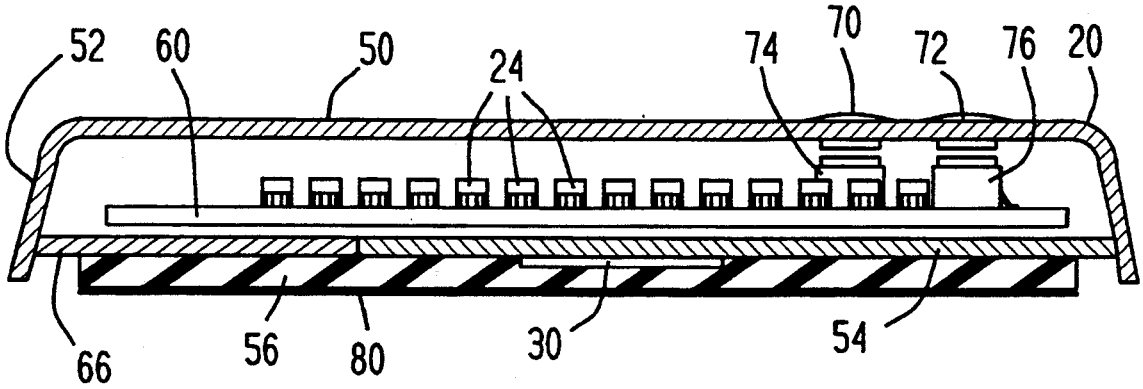
FIG. 2 is a front elevational section view of the electronic tuning device of FIG. 1.

As shown in FIGS. 1 and 2, an electronic tuner for use in tuning a musical instrument is constructed in accordance with one embodiment of the invention and includes a casing 20 in which is mounted a display, indicated generally at 22, with a row of light sources, such as twelve red-green dual light emitting diodes (LEDs) 24 which correspond to respective musical notes A, A♯ (B♭), B, C, C♯ (D♭), D, D♯ (E♭), E, F, F♯ (G♭), G and G♯ (A♭). The tuner includes an electronic circuit 28, FIG. 3, mounted in the case 20 wherein pickup head 30 converts a tone generated by the musical instrument into electrical signals which are amplified by amplifier 32, filtered in the frequency response amplifier 34, detected by zero crossing detector 36 and analyzed by microprocessor 38 to determine the fundamental frequency of the tone from the musical instrument. The microprocessor 38 then computes the nearest musical note and operates the corresponding light source 24 in the display 22. Furthermore the microprocessor 38 controls the operated light source to select a color indicating an in-tune condition or a deviation such as flat or sharp condition of the tone from nearest musical note and/or to blink the light source proportional to the deviation of the tone from the nearest musical note.

Referring back to FIGS. 1 and 2, the casing 20 has approximate outside overall dimensions of about 3 inches×1.5 inches×⅜ inch (7.6 centimeter×3.8 centimeter×1 centimeter). Casing 20 is made up of top member 50 with side walls 52 and a bottom plate 54 suitable secured in the side walls. Casing 20 is preferably molded from a durable plastic material. Side walls 52 extend slightly below the bottom edge of floor plate 54 to provide protection for the edges of an adhesive elastic pad 56 which is secured on the bottom surface of the floor plate 54. The pad 56 can be a conventional foam rubber or polyurethane tape such as that known as visco-elastic urethane tape which has adhesive on both sides. This sticky pad 56 has an exposed releasable pressure sensitive adhesive layer 80 which adheres to any smooth relatively flat and clean surface upon which it is pressed. The releasable nature of the adhesive 80 allows the tuning device to be removed from the surface to which it is stuck with the application of a moderate amount of lifting force.

Figure 3:
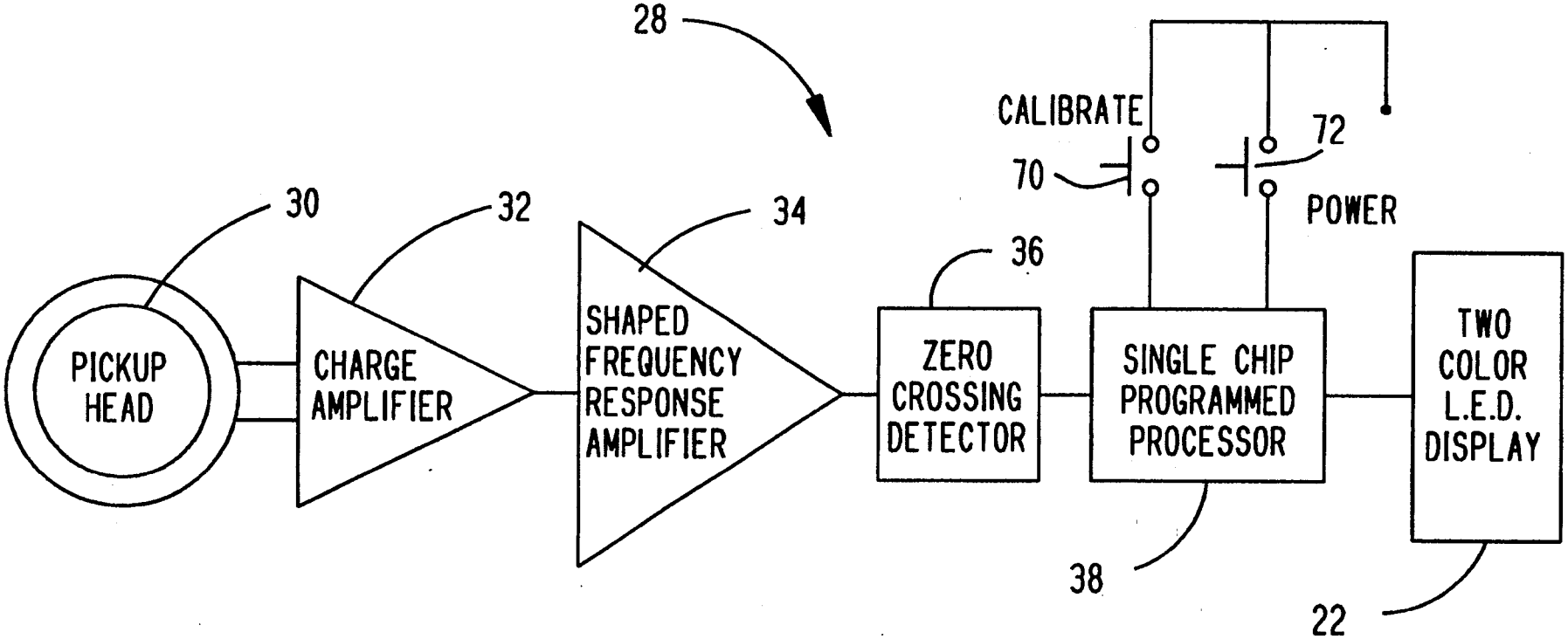
FIG. 3 is a block diagram of electrical circuitry in the electronic tuning device of FIGS. 1 and 2.

The top and bottom members 50 and 54 together with the side walls 52 define an enclosed box structure within which are mounted the electronic components forming the circuit 28 of FIG. 3. A circuit board 58 is mounted in the casing 20 and serves as a support and connection bus for the row of twelve two-color LED's 24 which selectively illuminate correspondingly labeled portions of a frosted face plate 62. Alternatively the illumination may be accomplished in many different ways such as by providing small cutouts in the top plate, by making a portion of the top plate transparent, or many other ways. The individual LED's may be labelled with indicia as:

A∘BC∘D∘EF∘G∘

Where the letters represent white keys on a piano and the "∘" symbols represent the black keys. Of course the exact form of labeling is arbitrary and a matter of design choice.

A battery 64, shown hidden in FIG. 1, supplies power for the electronic circuit. A door 66, FIG. 2, is provided in the bottom plate 54 for enabling the battery 64 to replaced. The battery cell 62 is preferably a nominal 3 volt lithium cell. Top member 50 also has two openings for mounting push button calibration switch 70 and push button power switch 72. Suitable indicia identifying these switches are formed on top 50. Push buttons 70 and 72 are designed to make contact with inner spring biased switch elements 74 and 76 respectively when manually depressed. As can be seen in FIG. 2, inner switch elements 74 and 76 are supported on circuit board 60. The pickup head or transducer 30 is centrally mounted on the bottom side of bottom plate 54 under the rubber pad 56. The rubber pad 56 dampens higher frequency components to serve as a high frequency filter which reduces the magnitude of harmonics of the tone being analyzed. This enables the circuit to more readily determine the fundamental frequency of the tone.

Figure 4:
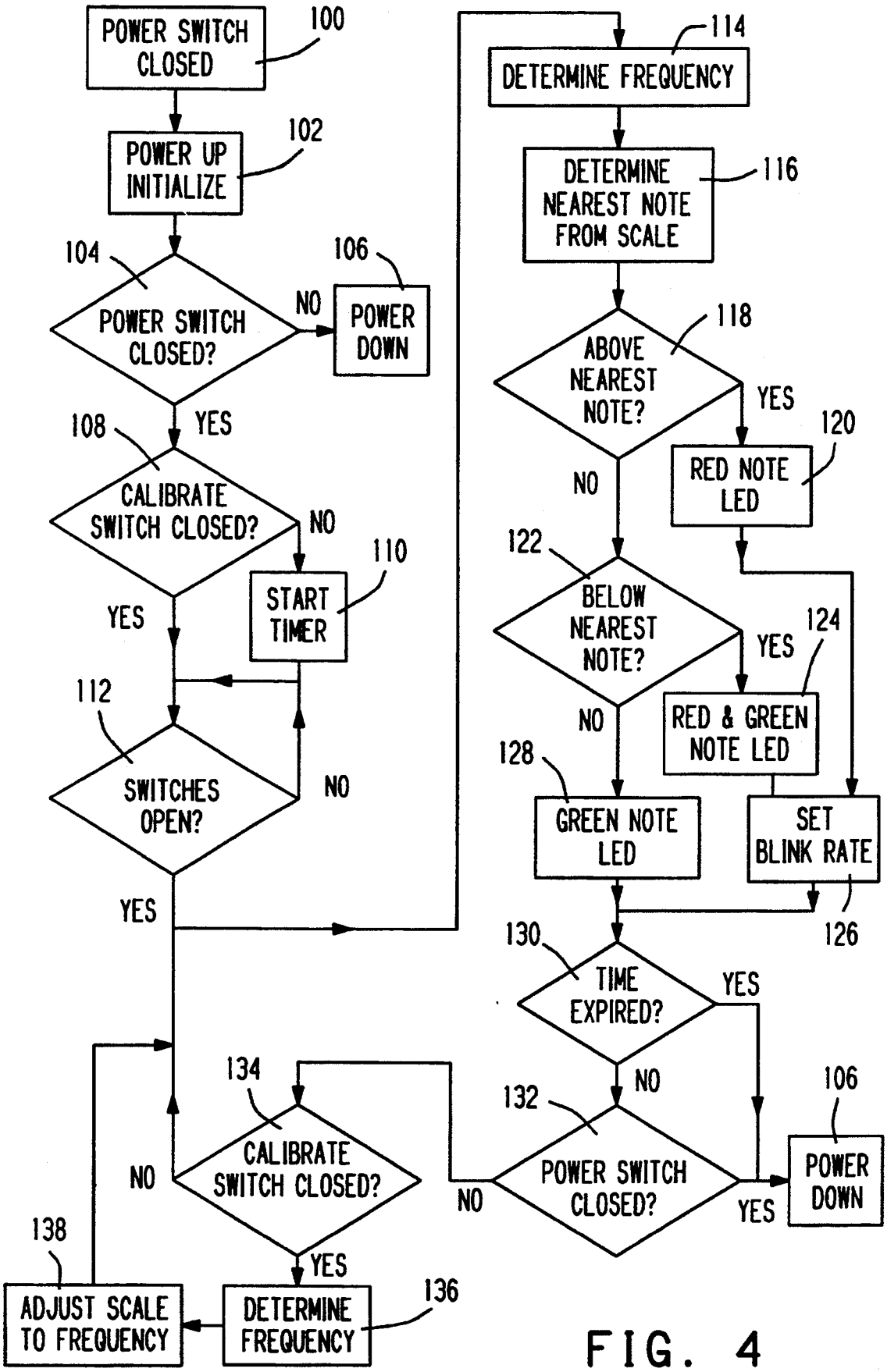
FIG. 4 is flow chart of a program employed in a microprocessor in the circuitry of FIG. 3.

The program for operating the processor chip 38 of FIG. 3 is illustrated in FIG. 4. Operation begins at the step 100 when the power switch 72 is closed and proceeds through power up initialization 102 to step 104 where is determined if the power switch 72 is depressed. The power switch must remain depressed sufficiently to distinguish from an incidental induced signal; otherwise the program branches to step 106 and a power down sequence.

If step 104 is true, the program branches to step 108 where it is determined if the calibration switch 70 is also depressed. If the calibration switch is not depressed, a power shut down timer is started in step 110. This timer will later power down the tuner after a predetermined time, for example about two minutes. Normal operation of the power switch 72 initiates the timer which automatically shuts down the tuner after the set delay. When the calibrate switch 70 is depressed before the power switch 72 is depressed and the calibrate switch is held depressed as the power switch is depressed, the program will bypass the timer initiating step 110 so that the tuner can operate continuously. Continuous operation is desirable for tuning some instruments, for example, harps, pianos, etc., where more time is needed for tuning than is provided by the standard turnoff delay.

After timer initiation or bypass, the program waits in step 112 for the power and calibration switches 70 and 72 to be released. The processor then begins procedure 114 to determine the fundamental frequency of the input signal from the transducer 30. The procedure 114 is a conventional procedure where the arriving output of the zero crossing detector 36 is used by the processor 38 to determine the fundamental frequency. For example, the fundamental frequency can be determined by first determining the appropriate octave and then determining the cent value (logarithmic) relative to the note "A" in that octave. After determining the fundamental frequency of the tone, the nearest standard note on a stored scale of notes is determined in step 116. Alternatively, step 116 can determine the nearest note by a conventional algorithm based upon frequency or cent value of one note, for example "A", in the corresponding octave. Next in step 118, it is determined if the sensed frequency is above the nearest standard note by more than a predetermined value, such as three cents. If step 118 is true, the red LED of that standard note is turned on in step 120. Otherwise the program proceeds to step 122 where it is determined setting if the sensed frequency is below the nearest standard note by more than the predetermined value, such as three cents. If step 122 is true the program will proceed to step 124 where both the red and green LEDs corresponding to the nearest standard note are turned on. The mixture of red and green gives an amber color. From step 120 or step 124, the program proceeds to step 126 where the corresponding LED or LEDs are turned off and on at a blink rate which is proportional to the absolute value of difference of the tone frequency from the nearest standard note. If steps 118 and 122 are both false, the program in step 128 turns on the green LED; i.e., the green LED indicates that the fundamental frequency of the tone being sensed is within ±three cents of the corresponding note. Additionally the green note is maintained on steady and not turned on and off at any blink rate to contrast the green in-tune condition from the out-of-tune conditions of sharpness (red) and flat (amber).

After operating the appropriate LED, the program in step 130 determines if the timer was started back in step 110 and if so whether the time has now expired. If the timer is active and the time has expired the program proceeds to the power down procedure 106 where any LEDs are turned off. Additionally in the power down procedure 106, the energization of the processor is placed in a minimum or quiescent power condition, and where appropriate, other circuit components are turned off. When step 130 is false, the program in step 132 determines if the power push button switch 72 has been operated. If it is now pressed the unit is powered down by the power down procedure 106. Thus the power switch acts as a toggle with the first press turning the unit on and a successive depression turning the unit off.

If the unit is not turned off by a successive depression of the power switch in step 132, the program proceeds to step 134 where the calibration switch 70 is again checked. If the calibrate switch 70 is depressed, the program branches to step 136 where the fundamental frequency of the tone being input is determined similar to step 114. Then in step 138 the scale used in step 116 is adjusted to correspond to the sensed fundamental frequency. Alternatively an offset, in either frequency or cents, can be determined in step 138 for use in step 114 or 116. The calibration steps 136 and 138 are designed to enable the tuning device to be calibrated on a second instrument, for example a piano, and then used to tune a first instrument, for example a guitar, to be in-tune with the second instrument.

If the calibration switch 70 is not found to be depressed in step 134, the program loops to the determine frequency step 114. Thus if a musician is tuning an instrument and does not press either push button switch 70 or 72 after initially starting operation of the tuning device, the device continuously loops and corrects the settings of the LED's as the musical instrument is tuned or until the timer, if set, expires.

Figure 5:
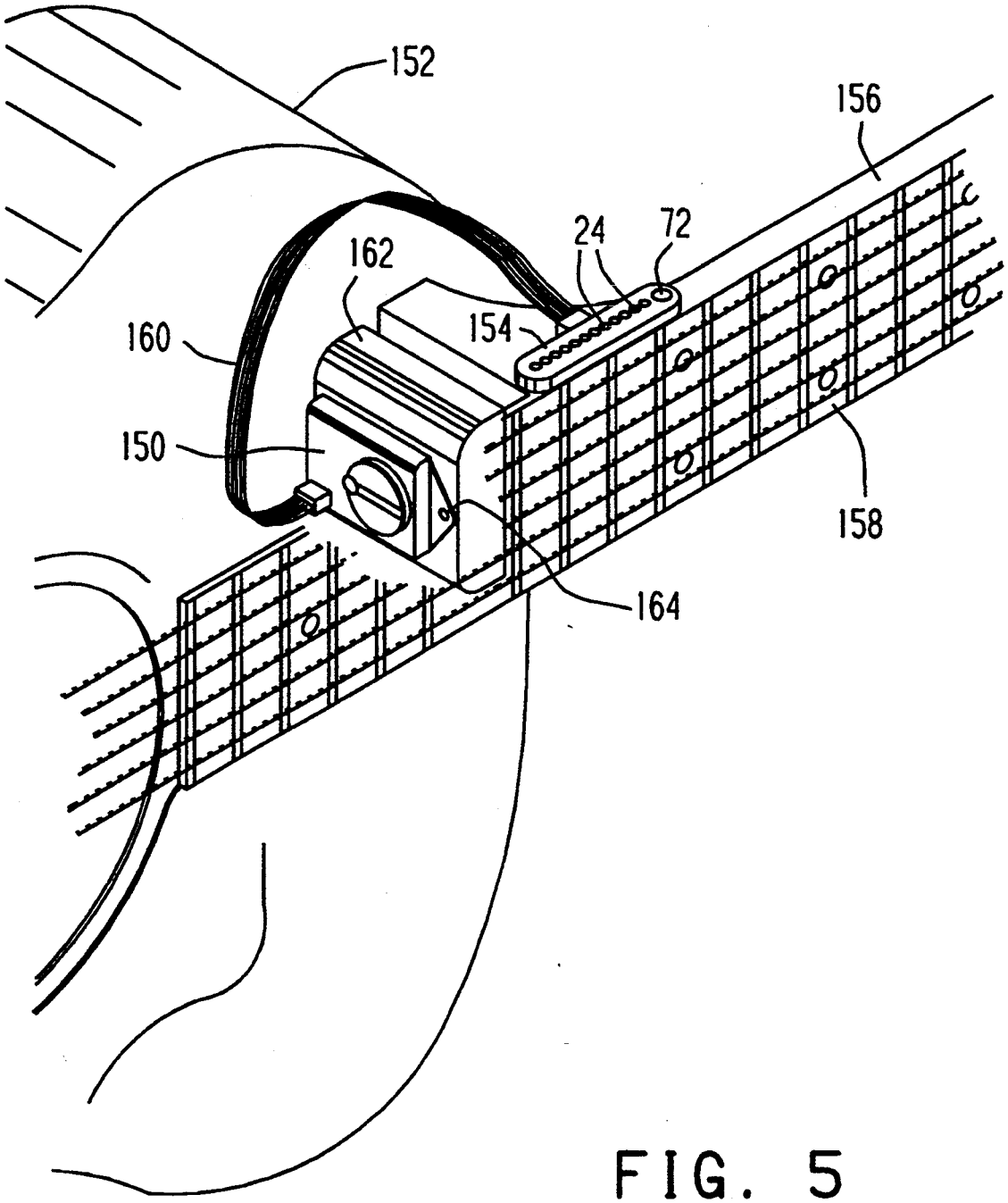
FIG. 5 is a partial perspective view of a variation of the electronic tuning device in accordance with the invention.

FIG. 5 shows a variation of the tuning device wherein a casing 150 of the tuning device is mounted directly on the instrument, such as within the sound box of a guitar 152. This variation differs from the embodiment of FIGS. 1–4 in that the row of twelve two-color LED's 24 are mounted in a separate narrow case 154 which is mounted on the upper surface 156 of finger board 158 of the guitar 152. The LED's 24 are connected to the control electronics in case 150 by means of a cable and plug assembly 160. Power switch 72 has also been placed in the narrow case 154 adjacent the LED's 24. Case 150 is attached, for example, to the support board 162 on the interior of guitar 152. Screw 164 is show as a semi-permanent attachment means for case 150 in this embodiment as opposed to the sticky pad attachment used in the embodiment FIG. 2. The narrow case 154 can be secured to the finger bar by an adhesive, screw, or any other suitable fastening means or can be embedded in some portion of the instrument, such as in the finger board.

Since many variations, modifications and changes in detail can be made to the above described embodiments, it is intended that the foregoing description and the accompanying drawings be interpreted as only illustrative and not as limiting to the scope and spirit of the invention as defined in the following claims.

What is claimed is:

1. An improved electronic tuning device for a musical instrument comprising;

a transducer for converting an acoustic tone played by the musical instrument into electrical signals;

frequency determination means for determining a fundamental frequency of said electrical signals and thus determining a fundamental frequency of said musical tone;

computing means for computing a nearest musical note to said fundamental frequency of said musical tone;

a display including a row of individual light sources corresponding to respective musical notes;

means responsive to the computing means for operating a light source in the row of light sources corresponding to the computed nearest musical note; and means responsive to a deviation of said fundamental frequency of said musical tone from the computed nearest musical note for controlling the operated light source to indicate the deviation whereby the operated light source indicates both the nearest musical note and the deviation.

2. The improved electronic tuning device of claim 1, wherein said controlling means blinks the operated light source proportionally to the deviation of said fundamental frequency of said musical tone from the computed nearest musical note.

3. The improved electronic tuning device of claim 1, wherein each of said light sources is adapted to selectively produce at least two colors, and said controlling means operates the operated light source to produce one color when said fundamental frequency of the musical tone is above the computed nearest musical note and operates the operated light source to produce a second color when said fundamental frequency of the musical tone is below the computed nearest musical note.

4. The improved electronic tuning device of claim 3, wherein each of said light sources is adapted to produce three colors, and said controlling means operates the operated light source to produce a third color when said fundamental frequency of the musical tone is substantially equal to the computed nearest musical note.

5. The improved electronic tuning device of claim 4 wherein each of said light sources includes red and green light emitting diodes, one of said three colors being red, another of said three colors being a combination of red and green, and the other of said three colors being green.

6. The improved electronic tuning device of claim 5 wherein the first color is red, the second color is a combination of red and green and the third color is green.

7. The improved electronic tuning device of claim 2, wherein each of said light sources is adapted to produce at least two colors, and said controlling means operates the operated light source to produce one color when said fundamental frequency of the musical tone is above the computed nearest musical note and operates the operated light source to produce a second color when said fundamental frequency of the musical tone is below the computed nearest musical note.

8. The improved electronic tuning device of claim 7, wherein each of said light sources is adapted to produce at least three colors, and said controlling means operates the operated light source to produce a third color when said fundamental frequency of the musical tone is substantially equal to the computed nearest musical note.

9. The improved electronic tuning device of claim 5, wherein the display comprises twelve red and green light emitting diodes corresponding to the twelve musical notes of a standard musical scale.

10. The improved electronic tuning device of claim 1, further comprising a power switch for turning the tuning device on and off;

timing means initiated by the power switch turning the tuning device on for automatically turning the tuning device off after a predetermined delay;

a calibration switch;

calibration means responsive to operation of the calibration switch for calibrating musical notes in accordance with said fundamental frequency of the musical tone; and timing disable means responsive to simultaneous operation of said power switch and said calibration switch for disabling the timing means to enable an indefinite duration of operation of the tuning device.

11. The improved electronic tuning device of claim 1, further comprising a case enclosing the electronic tuning device; and an elastic adhesive pad on the case for removably mounting the tuning device on a body of the musical instrument so that acoustic vibrations from the musical instrument operate the tuning device and wherein the resilient adhesive pad attenuates harmonics of said fundamental frequency of said musical tone.

12. The improved electronic tuning device of claim 1, wherein the device is adapted for mounting on a musical instrument having a finger board; and further comprising a first case enclosing the transducer means, the frequency determination means, the light source operating means, and the operated light source controlling means;

a second narrow case supporting the row of individual light sources and adapted to be mounted on an upper edge surface of the finger board; and a cable connecting the circuitry in the first case to the light sources in the second case.

* * * * *